US009499320B2

(12) United States Patent
Marco

(10) Patent No.: US 9,499,320 B2
(45) Date of Patent: Nov. 22, 2016

(54) CONTAINER CARRIER

(71) Applicant: Leslie S. Marco, Westmont, IL (US)

(72) Inventor: Leslie S. Marco, Westmont, IL (US)

(73) Assignee: Illinois Tool Works Inc., Glenview, IL (US)

( * ) Notice: Subject to any disclaimer, the term of this patent is extended or adjusted under 35 U.S.C. 154(b) by 474 days.

(21) Appl. No.: 13/835,182

(22) Filed: Mar. 15, 2013

(65) Prior Publication Data

US 2014/0197051 A1 Jul. 17, 2014

Related U.S. Application Data

(60) Provisional application No. 61/751,685, filed on Jan. 11, 2013.

(51) Int. Cl.

| | |
|---|---|
| ***B65D 75/00*** | (2006.01) |
| ***B65D 71/50*** | (2006.01) |
| ***B65D 71/06*** | (2006.01) |

(52) U.S. Cl.

CPC ..... *B65D 71/504* (2013.01); *B65D 71/063* (2013.01); *B65D 71/066* (2013.01)

(58) Field of Classification Search

USPC ..... 206/150, 151

See application file for complete search history.

(56) References Cited

U.S. PATENT DOCUMENTS

| | | | | |
|---|---|---|---|---|
| 3,404,773 | A | 10/1968 | Kirby, Jr. | |
| 3,650,395 | A | 3/1972 | Hobbs | |
| 4,018,331 | A * | 4/1977 | Klygis | 206/199 |
| 4,301,918 | A * | 11/1981 | Olsen | 206/150 |
| 4,330,058 | A * | 5/1982 | Klygis | 206/150 |
| 5,154,289 | A | 10/1992 | Van Erden | |

FOREIGN PATENT DOCUMENTS

GB 2 076 356 A 12/1981

* cited by examiner

*Primary Examiner* — Jacob K Ackun

(74) *Attorney, Agent, or Firm* — Pauley Erickson & Kottis

(57) ABSTRACT

A package for unitizing a plurality of containers that includes a flexible carrier having an array of container receiving apertures formed in longitudinal rows and transverse ranks wherein each container receiving aperture engages with a respective container of the plurality of containers and includes an outer band having a sufficiently narrow width to result in permanent yield following stretching engagement with and application to a respective container and a secondary package positioned with respect to the carrier and containers to form a unitized package.

4 Claims, 2 Drawing Sheets

CONTAINER CARRIER

CROSS REFERENCE TO RELATED APPLICATION

This application claims the benefit of U.S. Provisional Application No. 61/751,685, filed 11 Jan. 2013. The co-pending Provisional Application is hereby incorporated by reference herein in its entirety and is made a part hereof, including but not limited to those portions which specifically appear hereinafter.

BACKGROUND OF THE INVENTION

Field of the Invention

This invention relates to a flexible carrier for carrying a plurality of containers, such as cans.

Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage. Plastic ring carriers may also be used to array a plurality of containers into a tray or similar package for distributors. In such a manner, a plurality of containers that are intended for individual sale may be easily and inexpensively arrayed and then removed for sale.

The present invention is intended to enable a simple, inexpensive and effective solution for single can unitization and then distribution.

SUMMARY OF THE INVENTION

The present invention is directed to a flexible carrier for arraying containers within a secondary package that includes a series of container receiving apertures that are sized to create outer bands that neck or yield with application. As described, a particular arrangement of the carrier results in a unitized package within a secondary package such as shrink film, a tray or box.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
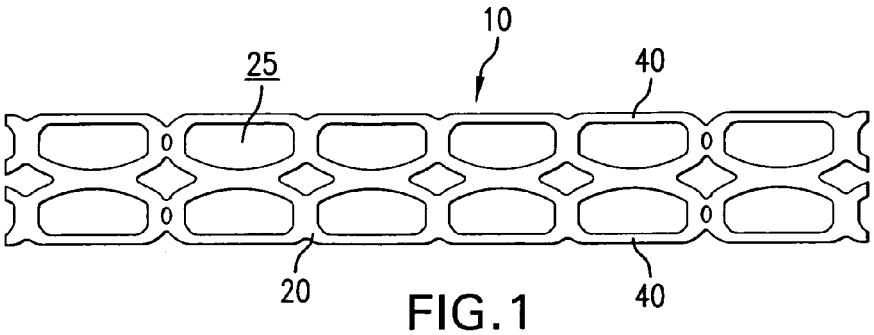
FIG. 1 is a side elevational view of a flexible carrier according to one preferred embodiment of this invention.
Figure 2:
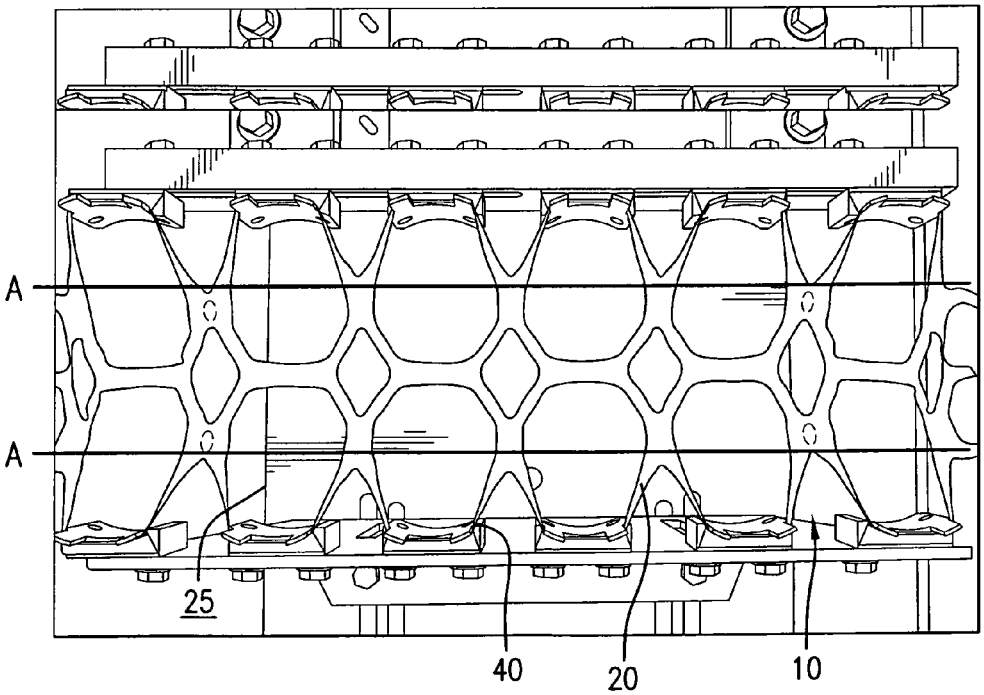
FIG. 2 is a side elevational view of the flexible carrier of FIG. 1 in a stretched condition.
Figure 3:
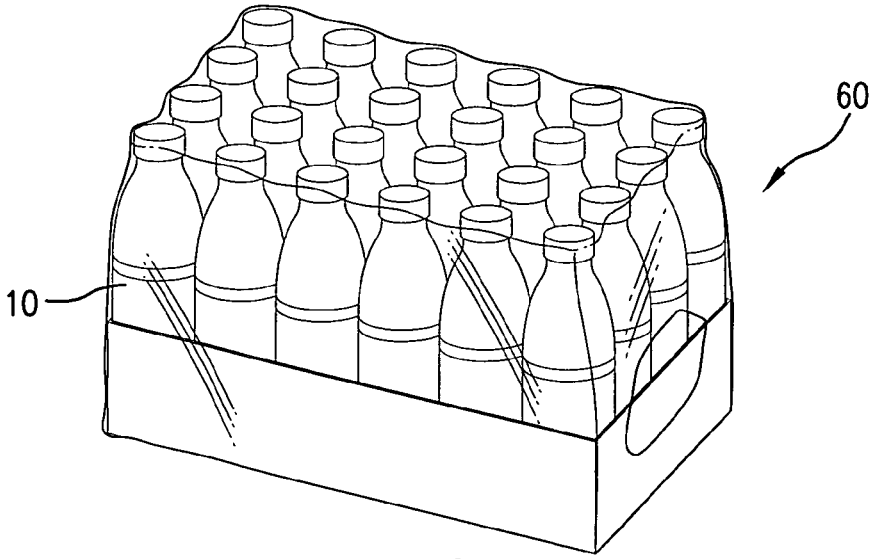
FIG. 3 is a front perspective view of a finished package used in connection with a flexible carrier according to one preferred embodiment of this invention.

FIGS. 1-3 show a flexible carrier 10 for arraying four, six or eight or more containers into a unitized sub-package which then may be placed into a secondary package, such as a shrink film wrap or a cardboard tray. Although FIGS. 1 and 2 illustrate various structures for flexible carrier 10 of the invention, the illustrations are exemplary, and the invention is not limited to the flexible carriers 10 or packages shown. For example, flexible carrier 10 may be alternatively configured and used to unitize ten, fourteen or any other desired number of containers.

Containers are preferably cans, however any other commonly unitized container may be used with flexible carrier 10 according to this invention. The containers are preferably, though not necessarily, like-sized within a single flexible carrier 10. The flexible carrier 10 is intended for cans of almost any size but primarily intended for 12 oz. to 20 oz. The subject invention seeks to minimize cost for transporting single containers for subsequent distribution by the merchandiser to the consumer.

Each flexible carrier 10 preferably includes a layer of flexible sheet 20 having a width and length defining therein a plurality of container receiving apertures 25, each for receiving a container. The plurality of container receiving apertures 25 are preferably arranged in longitudinal rows and longitudinal ranks so as to form an array of container receiving apertures 25, such as two rows by three ranks for a six container sub-package (a "six pack") or two rows by four ranks for an eight container sub-package, as shown in FIG. 1. Container receiving apertures 25 are preferably arcuate toward a center of the flexible carrier and generally straight along an outer portion of flexible carrier 10. The respective sub-packages are then preferably placed within a secondary package 60 such as shrink film wrap or a cardboard tray, or both such as shown in FIG. 3.

The package resulting from flexible carrier 10 includes a plurality of arrayed containers that are unitized within the secondary package 60. Flexible carriers 10 are generally applied to containers by stretching flexible sheet 20 surrounding container receiving apertures 25 around a container to array the containers. However, according to a preferred embodiment of this invention, portions of the stretched carrier 10, particularly in the outer bands 40 do not recover, thereby providing a loose engagement in the array of containers.

The result of the above described arrangement is a minimal cost carrier 10 to be used preferably for single can distribution. The carrier 10 is intended to be loose on the can so as not to be confused with a multipack. In one commercial form this carrier 10 is preferably used in combination with shrink film wrap to make a can case.

The subject design of the carrier 10, best shown in FIG. 1, allows for controlled necking or yielding of the carrier 10, particularly in the outer bands 40. In other words, carrier receiving apertures 25 have a section deliberately designed to give permanent deformation and thereby create a larger end result aperture. This aperture then is looser on the can body to allow for easier removal yet sturdy enough to array the cans through the distribution chain.

In this design, the yield section is preferably located at the outer web of the aperture bands, termed the outer bands 40 herein. Such outer bands 40 are preferably substantially narrower than the remaining webs in the carrier 10. One factor in making this arrangement function as desired is that the apertures 25 must neck or yield uniformly. The apertures 25 are preferably all of similar size when stretched or else they will not be properly located for application to the containers. In other words, the stretched apertures must be centered as much as possible over the containers. This is important since the desired application method utilizes jaws that only engage the outer carrier perimeter to open the apertures and rely on the apertures themselves to assist in opening up the adjacent inner portions of the apertures. If one of the apertures in this typical two row carrier were to open substantially more than the other then the apertures would not be adequately centered to go over the container.

FIG. 2 shows a two row wide carrier as described above as it is being stretched by opposing jaws for application. The outer jaws preferably engage the outer bands 40 and the typical carrier inner oblique and transverse bands which transmit the stretch through to open both apertures. The subject design deliberately yields or necks the outer carrier bands adjacent to the jaws yet as is seen the apertures are very uniform. Attempts at yielding the carrier either in the inner oblique or transverse inner webs were unsuccessful as the stretch was uncontrollable and one or the other aperture would open excessively.

According to one theory of operation, all the elongation by definition must occur at the outer carrier perimeter which means that the center as defined by the section between the 2 horizontal lines (A) in the photo must remain consistent which results in the carrier being centered over the containers during application.

A resulting secondary package 60 will typically include a tray, box and/or shrink wrapped unitized package that contains a fairly relaxed array of containers. An end user may then unwrap the shrink wrap and/or open the box and remove individual containers from the carrier 10 for placement on a shelf or in a refrigerator or for immediate use.

Figure 4:
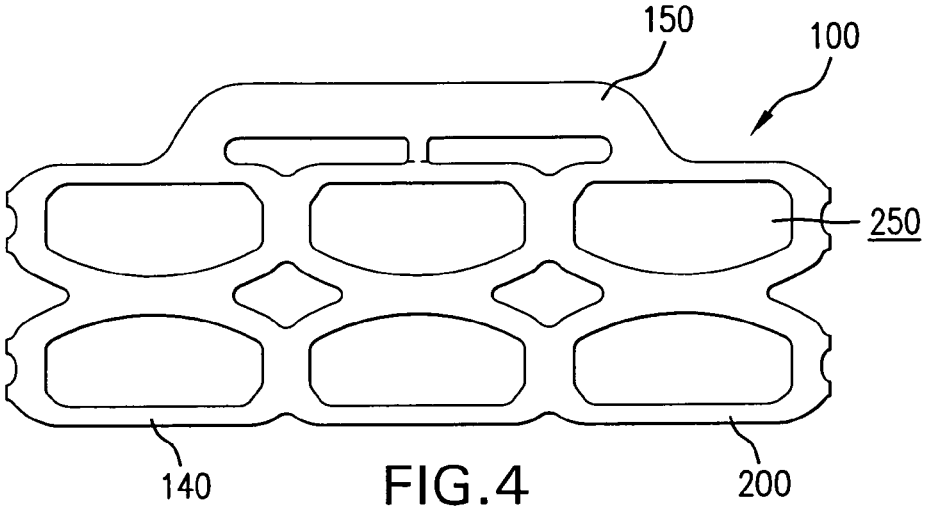
FIG. 4 is a side elevational view of a flexible carrier according to one preferred embodiment of this invention.
Figure 5:
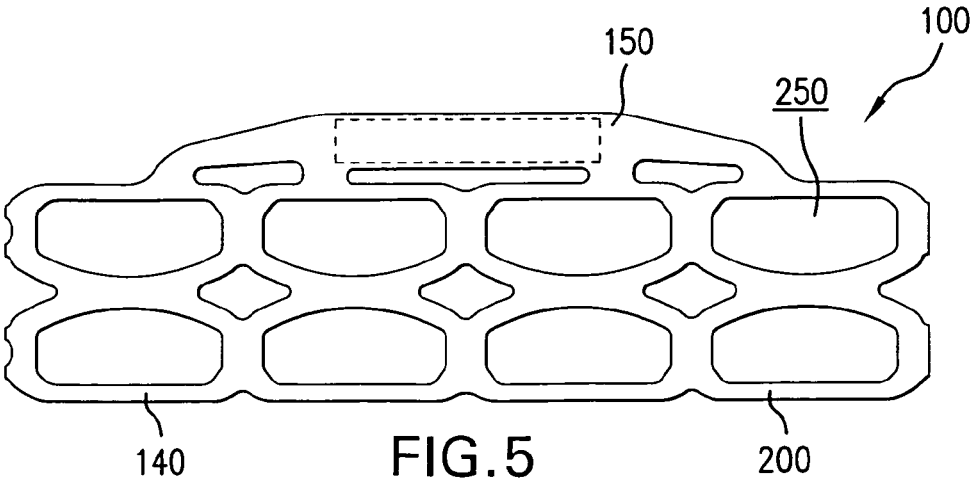
FIG. 5 is a side elevational view of a flexible carrier according to one preferred embodiment of this invention.

FIGS. 4 and 5 show an alternative embodiment wherein an integral handle 150 is incorporated with a plastic sheet 200 having a plurality of container receiving apertures 250. As in the preceding embodiments, a plurality of outer bands 140 are necked during application of the carrier 100 to individual containers. However, in this embodiment a secondary package is not used in connection with the carrier 100. Instead, the carrier 100 is used to unitize and directly carry the series of containers. Such an embodiment may be more suited for smaller groups of containers where the collective weight of the package is not excessive and permits portability of a carrier 100 having intentionally necked outer bands 140.

While in the foregoing specification this invention has been described in relation to certain preferred embodiments thereof, and many details have been set forth for purpose of illustration, it will be apparent to those skilled in the art that flexible carrier 10 and package are susceptible to additional embodiments and that certain of the details described herein can be varied considerably without departing from the basic principles of the invention.

What is claimed is:

1. A package for unitizing a plurality of containers comprising:

a flexible carrier having an array of container receiving apertures formed in longitudinal rows and transverse ranks wherein each container receiving aperture is arcuate along a center of the carrier and straight along an outer band, each engages with a respective container of the plurality of containers, and each includes an outer band that is substantially narrow than remaining bands in the carrier and having a sufficiently narrow width that is adapted to provide permanent yield following stretching engagement with and application to a respective wherein the flexible carrier is stretched and the outer band does not recover in engagement with the containers so that the carrier is positioned on the containers in a loose but sturdy arrangement to permit removal of the containers yet maintain the containers in a desired array; and a secondary package position with respect to the carrier and containers.

2. The package of claim 1 wherein the secondary package is at least one of shrink film, a tray and a box.

3. The package of claim 1 wherein only the outer bands are necked following engagement.

4. The package of claim 1 wherein the outer bands are necked uniformly across the carrier.

* * * * *